US007550675B2

(12) United States Patent
Susai et al.

(10) Patent No.: US 7,550,675 B2
(45) Date of Patent: Jun. 23, 2009

(54) ALUMINUM CONDUCTING WIRE

(75) Inventors: Kyota Susai, Tokyo (JP); Kazuo Yoshida, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 11/835,884

(22) Filed: Aug. 8, 2007

(65) Prior Publication Data

US 2008/0196923 A1 Aug. 21, 2008

Related U.S. Application Data

(63) Continuation of application No. PCT/JP2006/302421, filed on Feb. 7, 2006.

(30) Foreign Application Priority Data

Feb. 8, 2005 (JP) ..... 2005-032253
Sep. 20, 2005 (JP) ..... 2005-272437

(51) Int. Cl.
*H01B 7/00* (2006.01)

(52) U.S. Cl. ..... 174/110 R; 174/119 R; 174/119 C

(58) Field of Classification Search ..... 174/102 R, 174/103, 106 R, 108, 102 A, 102 C, 110 R, 174/113 R, 119 R, 119 C, 126.1, 126.2, 128.1
See application file for complete search history.

(56) References Cited

U.S. PATENT DOCUMENTS 27,830 A * 4/1860 Schoerne ..... 100/131
30,465 A * 10/1860 Schoerner ..... 220/9.2
2,572,562 A * 10/1951 Harrington ..... 310/179
3,261,908 A * 7/1966 Roche et al. ..... 174/128.1
3,513,252 A * 5/1970 Schoerner ..... 174/110 R
3,647,563 A * 3/1972 Schoerner ..... 148/523
3,647,939 A * 3/1972 Schoerner ..... 174/128.1
3,697,260 A * 10/1972 Humsicker ..... 420/529
3,770,515 A * 11/1973 Besel ..... 148/690
3,773,501 A * 11/1973 Nakajima et al. ..... 148/439
3,795,760 A * 3/1974 Raw et al. ..... 174/128.1
3,807,016 A * 4/1974 Schoerner et al. ..... 420/538

(Continued)

FOREIGN PATENT DOCUMENTS

JP 51-43307 A 10/1974

(Continued)

OTHER PUBLICATIONS

International Search Report of PCT/JP2006/302421, date of mailing May 16, 2006.

(Continued)

*Primary Examiner*—William H Mayo, III
(74) *Attorney, Agent, or Firm*—Westerman, Hattori, Daniels & Adrian, LLP.

(57) ABSTRACT

An aluminum conducting wire, containing a stranded conductor that is formed by stranding solid conductors of an aluminum alloy, in which the aluminum alloy comprises 0.1 to 1.0 mass % of Fe, 0.05 to 0.5 mass % of Cu, and 0.05 to 0.4 mass % of Mg, in which the total amount of Cu and Mg is 0.3 to 0.8 mass %, with the balance being aluminum and inevitable impurities, and a solid conductor of an aluminum alloy for the aluminum conducting wire.

9 Claims, 3 Drawing Sheets

U.S. PATENT DOCUMENTS

| | | | | | |
|---|---|---|---|---|---|
| 3,807,969 | A | * | 4/1974 | Schoerner et al. | 420/537 |
| 3,811,846 | A | * | 5/1974 | Schoerner et al. | 420/535 |
| 3,827,917 | A | * | 8/1974 | Zeigler et al. | 148/541 |
| 3,830,635 | A | * | 8/1974 | Chia et al. | 420/537 |
| 3,958,987 | A | * | 5/1976 | Chia et al. | 420/548 |
| 3,960,606 | A | * | 6/1976 | Chia et al. | 148/550 |
| 3,964,935 | A | * | 6/1976 | Wilks | 148/550 |
| 3,967,983 | A | * | 7/1976 | Chia et al. | 148/550 |
| 3,984,619 | A | * | 10/1976 | Raw et al. | 174/23 R |
| 4,028,141 | A | * | 6/1977 | Chia et al. | 148/550 |
| 4,080,222 | A | * | 3/1978 | Schoerner et al. | 148/550 |
| 4,080,223 | A | * | 3/1978 | Schoerner et al. | 148/550 |
| 4,140,549 | A | * | 2/1979 | Chia et al. | 148/551 |
| 4,182,640 | A | * | 1/1980 | Yokota | 148/438 |
| 4,216,031 | A | * | 8/1980 | Chia et al. | 148/550 |
| 5,110,545 | A | * | 5/1992 | McAuliffe et al. | 420/534 |
| 5,170,015 | A | * | 12/1992 | Kudo et al. | 174/128.1 |
| 2003/0165397 | A1 | * | 9/2003 | Auran et al. | 420/540 |
| 2004/0067678 | A1 | | 4/2004 | Yuasa et al. | |

FOREIGN PATENT DOCUMENTS

| | | | |
|---|---|---|---|
| JP | 49-43162 | B1 | 11/1974 |
| JP | 51-58698 | A | 5/1976 |
| JP | 3-184210 | A | 8/1991 |
| JP | 6-60739 | A | 3/1994 |
| JP | 6-089622 | A | 3/1994 |
| JP | 6-203639 | A | 7/1994 |
| JP | 2003-303517 | A | 10/2003 |
| JP | 2004-63290 | A | 2/2004 |
| JP | 2004-103254 | A | 4/2004 |
| JP | 2004-134212 | A | 4/2004 |
| JP | 2005-174554 | A | 6/2005 |

OTHER PUBLICATIONS

Concise explanation of documents.

* cited by examiner

ALUMINUM CONDUCTING WIRE

This application is a continuation of international application PCT/JP2006/302421, filed on Feb. 7, 2006.

TECHNICAL FIELD

The present invention relates to an aluminum conducting wire.

BACKGROUND ART

Conventionally, as an electric wire for automobile wiring, an electric wire having following properties has been mainly used: the electric wire which includes a stranded conductor obtained by stranding annealed copper wires according to JIS C 3102 or annealed copper wires subjected to tin plating or the like, as a conductor; and an insulator such as vinyl chloride or crosslinked polyethylene covering the conductor.

In recent years, the number of wiring positions increases with increase of the number of control circuits to be mounted on various electronic devices accompanying high performance and high function of automobiles. Accordingly, automobiles have became heavier due to the wirings while the wirings have been required for further reliability satisfying the high performance and high function of automobiles. In addition, reduction in diameter of the wire is required in response to the demand for reduction of the wiring in volume and making the automobile lightweight. Further, an electric wire for automobile is required to be readily reusable from the viewpoint of growing tendency of environmental protection. Meanwhile, the length of the wiring to a motor increases in an electric motorcar or a hybrid car in which a battery is mounted on the rear of the vehicle in terms of balance of the center of gravity or the like, Therefore, it is also required to decrease the weight of wiring materials.

For complying with these requirements, there is an electric conductor for automobiles in which desired electrical conductivity and solderability have been improved while bending resistance and tensile strength have been enhanced, by using a composite wire prepared by coating a steel wire with copper (e.g., JP-A-03-184210 ("JP-A" means unexamined published Japanese patent application)).

Further, there is a conductor of an electric wire for automobiles having a conductor sectional area of the upper limit of from 0.3 $mm^2$ to 2.0 $mm^2$ in which reduction of weight and possibility for reusing are improved and mechanical strength is ensured, by decreasing diameter of the conductor of an electric wire obtained by stranding hard drawn copper solid conductors and annealed copper solid conductors without using copper alloy wires (e.g., JP-A-06-060739).

Furthermore, there is a conductor of an electric cable for wiring for solving problems of electric connection by using a conductor for wiring formed by coating an aluminum wire with a zinc alloy, whereby copper is not mingled in reusing of automobiles since no copper materials are used, to suppress quality of steel materials to be reused from deteriorating (e.g., JP-A-06-203639).

In addition, there is a conductor composed of an aluminum alloy mainly used for aerial electric wires (e.g., JP-A-51-043307 and U.S. Pat. Nos. 3,697,260 and 3,773,501).

However, the above-described conductors of an electric wire for automobiles described in JP-A-03-184210 and JP-A-06-060739 are composed of a copper or a copper alloy. Therefore, they are still heavy weight. In addition, a solder is used for connecting the conductors. Accordingly, it has been a serious problem in reusing because lead or the like contained in the solder used at the time of connecting the conductor is one of environment pollutants.

The wire harness conductor for automobiles using an aluminum wire coated with a zinc alloy, as described in JP-A-06-203639, is quite effective as a part of attaining easy reusability and reduction of weight. However, the aluminum wire used for usual thin electric wires is mainly composed of hard drawn aluminum electric wire (JIS C 3108) and the like. Therefore, bending resistance of the wire is remarkably low as compared with a copper wire. Accordingly, if the aluminum electric wire is used at a place where repeated open and close action are occurred, such as a door hinge of the automobile, the aluminum electric wire is broken in earlier stage than the copper wire, and then it causes a problem that the aluminum wire cannot be used in conventional structural portions.

In the aluminum alloy electric wire described in JP-A-51-043307, bendability is only improved to an extent required for passing through a pulley in wiring works of the aerial power transmission wire. Thus, this wire does not satisfy bending resistance required in the aluminum conductor for automobiles that can be used in the present invention. In addition, since the diameter of the wire is large, it is hardly used as the aluminum conductor for automobiles that is prepared by stranding wires having a small diameter.

In U.S. Pat. No. 3,697,260, there are descriptions about flexibility, and breaking elongation is examined as a basis for evaluation of flexibility. However, this basis fundamentally differs from that in automobile technologies where a conductor having excellent bendability is required in terms of facilitating work efficiency for three-dimensional wiring of the electric wire in the body. Further, as bending resistance, evaluation is conducted by breaking after flexing several ten times. However, this basis for evaluation fundamentally differs from that for showing performance level required in the door of automobile, in which bending after flexing tens of thousands of times is necessary. Furthermore, the wire is a communication cable and, therefore, has a large diameter. Accordingly, it is difficult to apply the wire to the aluminum conductor for automobiles prepared by stranding wires having a small diameter.

While there are descriptions about bendability in U.S. Pat. No. 3,773,501, curvature of breaking by bending is evaluated using the wire's own diameter as a unit. However, this basis for evaluation also fundamentally differs from that for showing performance required in the door or the like of the automobile, in which bending after flexing tens of thousands of times is necessary. Further, since the wire is for use in aerial cables, the wire has a large diameter. Thus, the wire is hardly applicable to the aluminum conductor for automobiles that is prepared by stranding wires having a small diameter. Further, Sb is necessarily included.

Other and further features and advantages of the invention will appear more fully from the following description, appropriately referring to the accompanying drawings.

BRIEF DESCRIPTION OF DRAWINGS

FIG. 1-2 is a cross sectional view of the aluminum conducting wire formed by coating a stranded conductor comprising 7 solid conductors of an aluminum alloy with a resin, as an example of the embodiment of the aluminum conducting wire according to the present invention.

FIG. 1-3 is a cross sectional view of the aluminum conducting wire formed by coating a compressed stranded conductor comprising 7 solid conductors of an aluminum alloy with a resin, as an example of the embodiment of the aluminum conducting wire according to the present invention.

FIG. 2 is a view showing a bending test of the solid conductor of an aluminum alloy.

FIG. 3 is a view showing a flexibility test method of the conducting wire.

DISCLOSURE OF INVENTION

Figure 1:
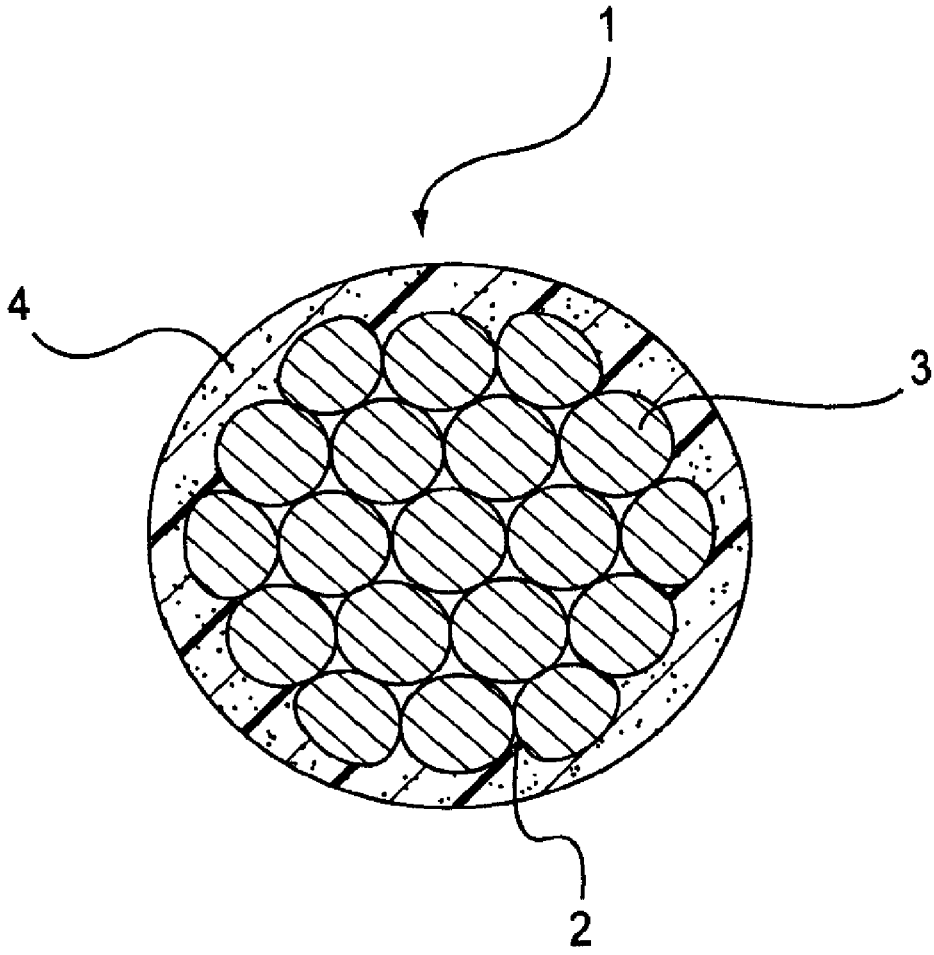
FIG. 1-1 is a cross sectional view of the aluminum conducting wire formed by coating a stranded conductor comprising 19 solid conductors of an aluminum alloy with a resin, as an example of the embodiment of the aluminum conducting wire according to the present invention.

According to the present invention, there are provided the following means:

(1) An aluminum conducting wire, comprising a stranded conductor that is formed by stranding solid conductors of an aluminum alloy, wherein the aluminum alloy comprises 0.1 to 1.0 mass % of Fe, 0.05 to 0.5 mass % of Cu, and 0.05 to 0.4 mass % of Mg, in which the total amount of Cu and Mg is 0.3 to 0.8 mass %, with the balance being aluminum and inevitable impurities;

(2) An aluminum conducting wire, comprising:

a stranded conductor that is formed by stranding solid conductors of an aluminum alloy; and a resin layer coating the stranded conductor;

wherein the aluminum alloy comprises 0.1 to 1.0 mass % of Fe, 0.05 to 0.5 mass % of Cu, and 0.05 to 0.4 mass % of Mg, in which the total amount of Cu and Mg is 0.3 to 0.8 mass %, with the balance being aluminum and inevitable impurities, and wherein the solid conductors have a wire diameter of from 0.07 to 1.50 mm;

(3) The aluminum conducting wire as described in the above item (1) or (2), wherein a tensile strength of the aluminum conducting wire is 110 MPa or more;

(4) An electric wire for automobile wiring, comprising:

a conductor, and a coating layer formed on the periphery of the conductor, wherein the conductor is the aluminum conducting wire as described in any one of the above items (1) to (3); and (5) A solid conductor of an aluminum alloy for a conducting wire, comprising 0.1 to 1.0 mass % of Fe, 0.05 to 0.5 mass % of Cu, and 0.05 to 0.4 mass % of Mg, in which the total amount of Cu and Mg is 0.3 to 0.8 mass %, with the balance being aluminum and inevitable impurities.

The aluminum conducting wire according to the present invention is made to be an aluminum material by using the solid conductors of an aluminum alloy to reduce the weight thereof, and is excellent in workability at wire drawing, electrical conductivity, stranding property (whether or not stranding processing can be carried out), bending resistance (against opening and closing of a door and vibration), flexibility (for example, when assembled as a wire harness of automobiles), joint property (to a metal of a different kind) and heat resistance. In addition, reusing of the wire is largely facilitated as compared with wire harness conductors made of copper wires or the like, and clean reusing is possible without generating substances harmful to the environment. Accordingly, the aluminum conducting wire is quite favorable in industries and for the environment.

BEST MODE FOR CARRYING OUT THE INVENTION

The present invention is described below in detail.

Figures 1, 2:
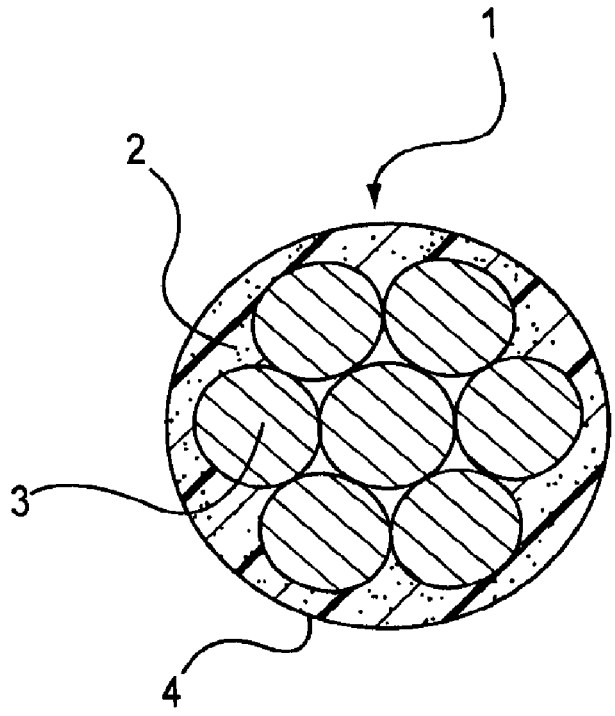
Figures 1, 2, 3:
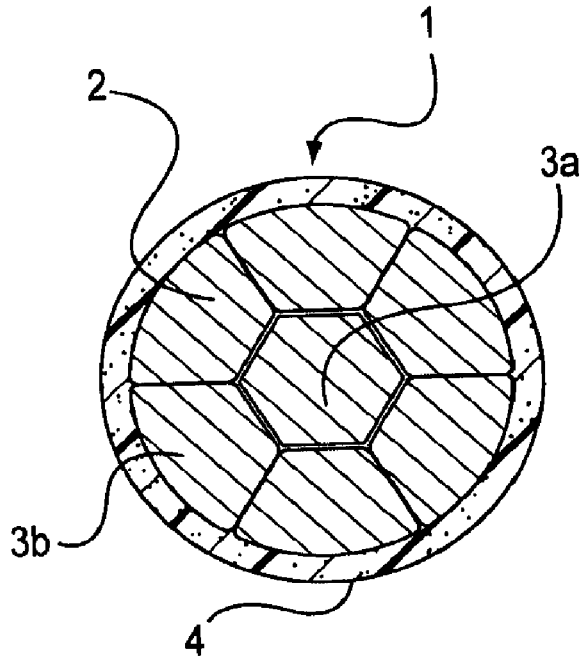
Figure 2:
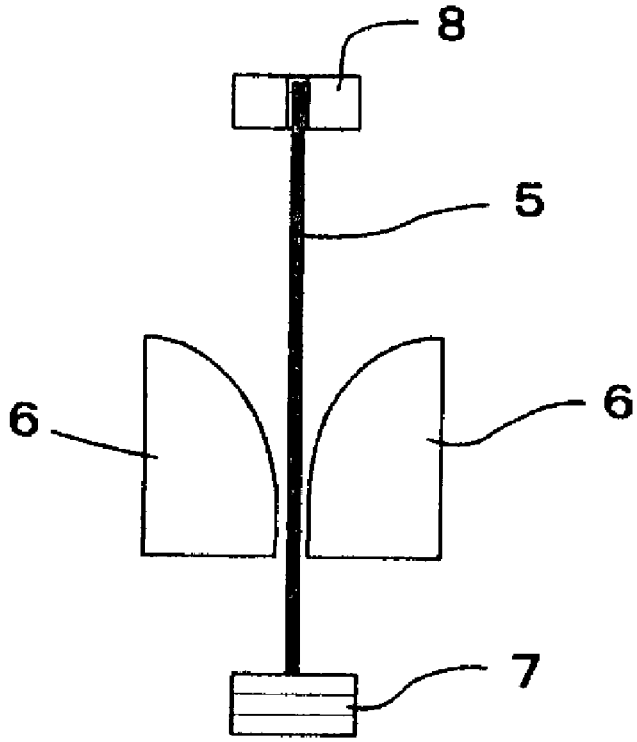
Figure 3:
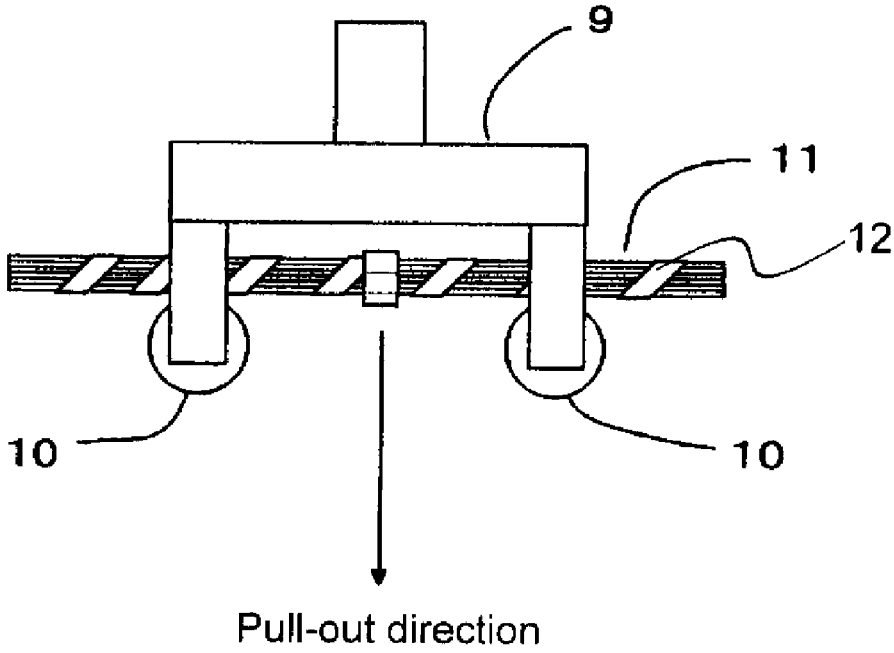

FIGS. 1-1, 1-2 and 1-3 show three embodiments of the cross sections of the aluminum conducting wires as preferable embodiments of the aluminum conducting wire according to the present invention. The same reference numerals denote the same parts in FIGS. 1-1, 1-2 and 1-3. Reference numeral 1 denotes an aluminum conducting wire, reference numeral 2 denotes a stranded conductor that is formed by stranding solid conductors of an aluminum alloy 3, and reference numeral 4 denotes a coating resin. In FIG. 1-3, reference numeral 3*a* denotes a solid conductor of an aluminum alloy (compressed conducting wire) having an approximately hexagonal cross section, and reference numeral 3*b* denotes solid conductors of an aluminum alloy (compressed conducting wires) disposed around the hexagonal solid conductor and having an approximately rectangular cross section. The total number of solid conductors of an aluminum alloy 3, or 3*a* and 3*b* constituting the stranded conductor 2, is determined by the performance of the equipment used.

Next, technical significance of the composition of the aluminum alloy constituting the solid conductor of an aluminum alloy 3 (or 3*a* and 3*b*) according to the present invention will be described below.

The amount of Fe to be added is defined in the range from 0.1 to 1.0 mass %, because bending resistance at a high level required for the electric wire for automobiles cannot be attained when the content is less than 0.1 mass %, while not only electrical conductivity required for the electric wire for automobiles is not obtained but also bendability decreases due to primary crystallization of Al—Fe series compounds when the content exceeds 1.0 mass %. In this case, although crystallization of the compounds may be suppressed by keeping the temperature of the molten metal sufficiently high and by increasing the cooling rate for solidification, this process causes decrease of electrical conductivity since Fe is supersaturated in the alloy. The amount of Fe is preferably from 0.20 to 0.8 mass %.

The amount of Cu to be added is defined in the range from 0.05 to 0.5 mass %, because bending resistance at a high level required for the electric wire for automobiles cannot be attained when the content is less than 0.05 mass %, while electrical conductivity becomes poor when the content exceeds 0.5 mass %. The amount of Cu is preferably from 0.1 to 0.4 mass %.

The amount of Mg to be added is defined in the range from 0.05 to 0.4 mass %, because bending resistance required for the electric wire for automobiles cannot be attained when the content is less than 0.05%, while electrical conductivity becomes poor when the content exceeds 0.4 mass %. The amount of Mg is preferably from 0.1 to 0.35 mass %.

The total amount of Cu and Mg is defined in the range from 0.3 to 0.8 mass % for improving bending resistance by simultaneously adding Cu and Mg. Bending resistance at a high level required for the electric wire for automobiles cannot be attained when the total amount is less than 0.3 mass %, while electrical conductivity becomes poor when the amount exceeds 0.8 mass %. Accordingly, the total amount of these components is preferably from 0.3 to 0.7 mass %. The mass ratio of Mg:Cu is preferably from 0.125:1 to 1.25:1.

The amount of inevitable impurities is preferably as small as possible for decreasing electrical conductivity. It is preferable that the amount of Si is 0.10 mass % or less, the amount of Mn is 0.02 mass % or less, and the total amount of Ti and V is 0.025 mass % or less. Zr may be contained in an amount of up to about 0.1 mass %, since heat resistance is improved by allowing Al—Zr series compounds to precipitate.

The aluminum conducting wire formed by stranding solid conductors of an aluminum alloy each having a diameter from 0.07 to 1.50 mm to give a stranded wire, and by coating the stranded wire with a resin, preferably has a tensile strength of 110 MPa or more. The upper limit of the tensile strength is not particularly limited, but it is generally 400 MPa or less. This reason is that, for example, the aluminum conducting wire is required to have a tensile strength above a prescribed level for preventing joint parts between the aluminum conducting wire and terminals from being broken, during assembly work of the aluminum conducting wire to the automobile. A tensile strength of 110 MPa permits workability of the joint parts to be ensured (no breakage after applying vibration in an axial direction at a sweep rate of 98 m/sec and a frequency from 50 to 100 Hz, for 3 hours). Accordingly, the solid conductors of an aluminum alloy to be used are also required to have a tensile strength of at least 110 MPa or more. In this connection, it is known that the resin coating layer does not substantially contribute the tensile strength of the aluminum conducting wire.

Electrical conductivity is required to be higher, in accordance with higher performance of electronic equipments provided in automobiles. Electrical conductivity is preferably 55% IACS or more. The upper limit of electrical conductivity is not particularly limited, but it is generally 66% IACS or less.

When higher flexibility is necessary while maintaining practically sufficient bendability, it is possible to attain these effects by heat-treatment after wire drawing or stranding processing. The heat-treatment may be applied under such a condition that completes the recrystallization after the heat treatment and is enough for recovering elongation and electrical conductivity of the wire material. The condition may be at 250° C. or more. The time for heat-treatment is not particularly limited, but it is preferably from 30 minutes to 6 hours.

Herein, when the heat-treatment for recrystallization is carried out, it is possible to improve bendability while the tensile strength is maintained, by applying a low temperature annealing after wire drawing. The annealing is preferably carried out at a condition of a temperature from 80° C. to 120° C. for 100 to 120 hours.

In the aluminum conducting wire of the present invention, integrity of the surface (this term means that there is no flaw such as cracks, invasion of foreign substances and peeling) is important for improving bending resistance, and the number of dice streaks is preferably as small as possible after wire drawing. In addition, bending resistance can be maintained while flexibility is maintained when the wire is hardened only at near the surface by applying skin pass rolling or the like during wire drawing after the heat treatment.

As the coating resin that can be used in the present invention, polyvinyl chloride (PVC) or a non-halogen resin is preferable in terms of insulation property and flame-retardant. The thickness of the coating layer is not particularly limited, but excessive thickness is not preferable in view of the industrial productivity. Although it depends on the diameter of the stranded wire, the thickness is preferably about from 0.10 mm to 1.70 mm.

The present invention will be described in more detail based on examples given below, but the invention is not meant to be limited by these.

EXAMPLES

Example 1

Table 1 shows the component compositions (balance was an aluminum and inevitable impurities) of the Al alloys according to the Examples and Comparative examples. Al alloys each having the component composition shown in Table 1 each were melted by a usual method, and cast in a casting mold with a dimension of 25.4 mm square, to give ingots. Then, each of the ingots was kept at 400° C. for 1 hour, followed by hot rolling with a grooved roll to process into a rough drawing wire with a wire diameter of 9.5 mm. The method for processing into a rough drawing wire is not restricted to the hot rolling method using an ingot having a square cross section, and other processing methods such as a continuous cast-rolling method or an extrusion method may be used.

Subsequently, the obtained rough drawing wire was drawn into a wire with a wire diameter of 0.9 mm, followed by heat treatment at 350° C. for 2 hours and quenching, and the wire was further drawn, to obtain solid conductors of an aluminum alloy 3 with a wire diameter of 0.32 mm as shown in FIG. 1-1. Electrical conductivity was measured after heat-treatment and quenching of the 0.9-mm wire material.

Since the tensile strength, bending resistance and electrical conductivity of the aluminum conducting wire prepared by coating a stranded conductor with a resin according to the present invention is affected by properties of the solid conductors of an aluminum alloy used, the prepared solid conductors of an aluminum alloy with a wire diameter of 0.32 mm were heat-treated at 350° C. by keeping the temperature for 2 hours and then slowly cooled, and the tensile strength and bending resistance were evaluated.

The tensile strength of each of the solid conductor of an aluminum alloy with a wire diameter of 0.32 mm was measured according to JIS Z2241 (n=3), and its average value was obtained.

The electrical conductivity of each of the solid conductor of an aluminum alloy with a wire diameter of 0.32 mm was also measured in a thermostatic tank controlled at 20° C. (±0.5° C.) using a four-terminal method, and electrical conductivity was calculated from the resistivity obtained. The distance between the terminals was set to 100 mm.

The bending resistance was tested using a bending test apparatus as shown in FIG. 2. A sample 5 of the solid conductor of an aluminum alloy 3 with a wire diameter of 0.32 mm as a test sample was clamped with mandrels 6, and a 50 g weight 7 was hung at the lower end of the sample as a load for suppressing the wire from being bent. The upper end of the sample was fixed with a clamp 8.

In this state, the weight 7 was swung right and left for alternately bending the sample 5 to right and left side by 30°. The bending was conducted at a rate of 100 times/minute. The number of bending until breakage was measured for each sample. Note that right and left bending was counted as one (1) flexing, and the distance between the mandrels was adjusted at 1 mm so that the sample of the solid conductor of an aluminum alloy was not oppressed during the test.

The sample was judged to be broken when the weight 7 hung at the lower end of the sample 5 was dropped. The mandrel 6 had an arc corresponding to a radius of 90 mm, and a bend stress equivalent to bending with a radius of 90 mm may be applied to the sample.

The samples were totally evaluated with respect to material characteristics such as tensile strength, bending resistance and electrical conductivity, and environmental characteristics such as possibility of reduction of weight and compatibility to reusing. The evaluation criteria were bending resistance of 50,000 times or more, tensile strength of 110 MPa or more, electrical conductivity of 55.0% IACS or more, possibility of reduction of weight smaller than the weight of conventional copper wire, and higher turnover of reusing. A sample satisfying all these criteria was evaluated as "○(good)", a sample that satisfied the material characteristics but not the environmental characteristics was evaluated as "Δ", and a sample that did not satisfy any one of the material characteristics was evaluated as "×(poor)". A sample that satisfying 60,000 times or more of bending resistance and 56.5% IACS or more of electrical conductivity as well as environmental characteristics was evaluated as "◎(excellent)". The results of measurement are also shown in table 1.

TABLE 1

| | Fe mass % | Cu mass % | Mg mass % | Mg + Cu mass % | Number of bending times | Strength MPa | Electrical conductivity % IACS | Evaluation |
|---|---|---|---|---|---|---|---|---|
| Example 1 | 0.231 | 0.236 | 0.115 | 0.351 | 66,600 | 136 | 58.8 | ◎ |
| Example 2 | 0.212 | 0.433 | 0.116 | 0.549 | 86,000 | 146 | 58.2 | ◎ |
| Example 3 | 0.269 | 0.408 | 0.055 | 0.463 | 51,800 | 138 | 56.7 | ○ |
| Example 4 | 0.275 | 0.482 | 0.066 | 0.548 | 51,000 | 145 | 55.4 | ○ |
| Example 5 | 0.228 | 0.289 | 0.052 | 0.341 | 51,900 | 137 | 56.1 | ○ |
| Example 6 | 0.275 | 0.125 | 0.213 | 0.338 | 52,900 | 115 | 57.0 | ○ |
| Example 7 | 0.263 | 0.300 | 0.220 | 0.520 | 72,800 | 138 | 56.8 | ◎ |
| Example 8 | 0.220 | 0.489 | 0.218 | 0.707 | 85,300 | 145 | 55.5 | ○ |
| Example 9 | 0.223 | 0.189 | 0.355 | 0.544 | 63,500 | 135 | 55.3 | ○ |
| Example 10 | 0.111 | 0.313 | 0.385 | 0.698 | 69,000 | 146 | 55.0 | ○ |
| Example 11 | 0.224 | 0.273 | 0.324 | 0.597 | 67,200 | 141 | 55.5 | ○ |
| Example 12 | 0.220 | 0.184 | 0.237 | 0.421 | 61,900 | 138 | 56.6 | ◎ |
| Example 13 | 0.216 | 0.344 | 0.093 | 0.437 | 73,500 | 140 | 56.1 | ○ |
| Comparative example 1 | 0.226 | 0.057 | 0.117 | 0.174 | 39,700 | 111 | 60.7 | x |
| Comparative example 2 | 0.314 | 0.107 | 0.124 | 0.231 | 48,200 | 112 | 60.6 | x |
| Comparative example 3 | 0.189 | 0.109 | 0.109 | 0.219 | 49,000 | 113 | 61.3 | x |
| Comparative example 4 | 0.294 | 0.003 | 0.101 | 0.104 | 30,600 | 111 | 60.7 | x |
| Comparative example 5 | 0.497 | 0.003 | 0.124 | 0.127 | 39,400 | 120 | 60.0 | x |
| Comparative example 6 | 1.191 | 0.003 | 0.043 | 0.046 | 34,400 | 133 | 59.0 | x |
| Comparative example 7 | 1.207 | 0.004 | 0.146 | 0.149 | 48,900 | 142 | 57.6 | x |
| Comparative example 8 | 1.147 | 0.004 | 0.222 | 0.227 | 42,100 | 147 | 57.5 | x |
| Comparative example 9 | 0.274 | 0.107 | 0.002 | 0.109 | 32,500 | 112 | 57.6 | x |
| Comparative example 10 | 0.279 | 0.075 | 0.001 | 0.076 | 38,500 | 117 | 57.9 | x |
| Comparative example 11 | 0.291 | 0.123 | 0.001 | 0.125 | 40,900 | 116 | 57.1 | x |
| Comparative example 12 | 0.274 | 0.191 | 0.001 | 0.192 | 44,300 | 126 | 56.9 | x |
| Comparative example 13 | 0.276 | 0.005 | 0.112 | 0.117 | 42,600 | 116 | 60.5 | x |
| Comparative example 14 | 0.217 | 0.130 | 0.113 | 0.244 | 48,200 | 120 | 59.4 | x |
| Comparative example 15 | 1.256 | 0.004 | 0.126 | 0.129 | 39,300 | 141 | 58.2 | x |
| Comparative example 16 | 0.274 | 0.221 | 0.048 | 0.269 | 42,100 | 135 | 57.5 | x |
| Comparative example 17 | 0.268 | 0.533 | 0.049 | 0.582 | 59,200 | 145 | 54.5 | x |
| Comparative example 18 | 0.270 | 0.800 | 0.050 | 0.850 | 59,800 | 151 | 54.0 | x |
| Comparative example 19 | 0.265 | 0.650 | 0.100 | 0.750 | 90,100 | 150 | 54.8 | x |
| Comparative example 20 | 0.217 | 0.611 | 0.216 | 0.827 | 86,000 | 148 | 54.0 | x |
| Comparative example 21 | 0.080 | 0.403 | 0.115 | 0.518 | 48,100 | 130 | 58.8 | x |
| Comparative example 22 | 0.214 | 0.233 | 0.410 | 0.643 | 75,000 | 150 | 54.5 | x |
| Conventional example 1 | | Annealed copper | | | 85,000 | 240 | 100.0 | Δ(weight) |
| Conventional example 2 | | Pure aluminum | | | 27,000 | 95 | 62.0 | x |

As is clear from the results in Table 1, Examples according to the present invention were excellent in all of bending resistance, tensile strength and electrical conductivity, and further the aluminum alloy materials were sufficiently able to enjoy reduction of weight and compatibility to reusing.

On the contrary, the comparative examples were poor in at least one of bending resistance, tensile strength and electrical conductivity, since the content of the components and/or the total amount of Mg and Cu was out of the range defined in the present invention. In addition, the annealed copper wire as the conventional example was excellent in bending resistance, but it was heavy and poor in compatibility to reusing since the conducting wire is made of a copper alloy. Bending resistance was extremely poor in the pure aluminum conducting wire as the conventional example.

Example 2

Stranded wire 2 with a cross sectional area of the conductor of 0.5 $mm^2$ was prepared by stranding seven solid conductors of an aluminum alloy 3 (strand pitch 20 mm) with a wire diameter of 0.32 mm of the Examples 1 and 2 according to the present invention in Table 1 prepared in Example 1. One solid conductor was placed at the center and remaining 6 solid conductors were disposed around the center. The aluminum conducting wire as shown in FIG. 1-3 were prepared by coating the stranded solid conductors with a non-halogen resin 4 after a degressive work of the stranded solid conductors. The tensile strength of each conducting wire was measured to be 60 N or 75 N by the same method as in Example 1. These values are enough for satisfying reliability of the joint part between the aluminum conducting wire and the terminal in the assembly of automobiles.

Example 3

Two stranded wires each having a cross sectional area of the conductor of 0.5 $mm^2$ were prepared by stranding seven solid conductors of an aluminum alloy of Example 1 according to the present invention with a wire diameter of 0.32 mm or copper wires of the conventional example, as shown in FIG. 1-3 (strand pitch 20 mm). Each stranded wire was coated by a resin, and thirty stranded wires were bundles and wrapped with a PVC tape. The bundle of the stranded wires was used for evaluation of flexibility.

FIG. 3 is a view showing the flexibility test method. The sample 11 with a length of 350 mm was supported with reels 10 having a support diameter of 19 mm of a two-point support flexibility test jig 9 with a distance of support of 100 mm. Pull-out strength of the sample (conducting wire) 11 was measured by pulling the middle portion between both reels to the downward direction with a tensile tester (not shown) to evaluate flexibility. The reference numeral 12 denotes a PVC tape.

The pull-out strength of the example 1 according to the present invention was 11.7 N and 8.1 N when the coating resins were a non-halogen resin and PVC resin, respectively, while the pull-out strength of the copper wire of the conventional example was 13.6 N. The results show that the value for the pull-out strength of the aluminum conducting wire of the present invention was lower than that of the copper wire, and that flexibility of the aluminum conducting wire of the present invention was remarkably improved.

INDUSTRIAL APPLICABILITY

Since the aluminum alloy conducting wire of the present invention is light weight and excellent in bendability and flexibility with excellent compatibility to for use in moving portions such as driving parts, it is suitable for use in automobiles, particularly for wire harnesses or battery cables.

In particular, the aluminum alloy conducting wire of the present invention is suitable as the automobile wire harness made for reduction of weight as much as possible in terms of improvement of performance of the automobile.

Further, the solid conductor of an aluminum alloy of the present invention is suitable for use in the aluminum alloy conducting wire.

Having described our invention as related to the present embodiments, it is our intention that the invention not be limited by any of the details of the description, unless otherwise specified, but rather be construed broadly within its spirit and scope as set out in the accompanying claims.

The invention claimed is:

1. An aluminum conducting wire, comprising a stranded conductor that is formed by stranding solid conductors of an aluminum alloy, wherein the aluminum alloy comprises 0.1 to 1.0 mass % of Fe, 0.10 mass % or less of Si, 0.05 to 0.5 mass % of Cu, and 0.05 to 0.4 mass % of Mg, in which the total amount of Cu and Mg is 0.3 to 0.8 mass %, with the balance being aluminum and inevitable impurities; and wherein the solid conductors of an aluminum alloy show resistance against bending of 50,000 times or more.

2. The aluminum conducting wire according to claim 1, wherein a tensile strength of the aluminum conducting wire is 110 MPa or more.

3. An electric wire for automobile wiring, comprising:

a conductor, and a coating layer formed on the periphery of the conductor, wherein the conductor is the aluminum conducting wire according to claim 2.

4. An electric wire for automobile wiring, comprising:

a conductor, and a coating layer formed on the periphery of the conductor, wherein the conductor is the aluminum conducting wire according to claim 1.

5. An aluminum conducting wire, comprising:

a stranded conductor that is formed by stranding solid conductors of an aluminum alloy; and a resin layer coating the stranded conductor;

wherein the aluminum alloy comprises 0.1 to 1.0 mass % of Fe, 0.10 mass % or less of Si, 0.05 to 0.5 mass % of Cu, and 0.05 to 0.4 mass % of Mg, in which the total amount of Cu and Mg is 0.3 to 0.8 mass %, with the balance being aluminum and inevitable impurities;

wherein the solid conductors have a wire diameter of from 0.07 to 1.50 mm; and wherein the solid conductors of an aluminum alloy show resistance against bending of 50,000 times or more.

6. The aluminum conducting wire according to claim 5, wherein a tensile strength of the aluminum conducting wire is 110 MPa or more.

7. An electric wire for automobile wiring, comprising:

a conductor, and a coating layer formed on the periphery of the conductor, wherein the conductor is the aluminum conducting wire according to claim 6.

8. An electric wire for automobile wiring, comprising:

a conductor, and a coating layer formed on the periphery of the conductor, wherein the conductor is the aluminum conducting wire according to claim 5.

9. A solid conductor of an aluminum alloy for a conducting wire, comprising 0.1 to 1.0 mass % of Fe, 0.10 mass % or less of Si, 0.05 to 0.5 mass % of Cu, and 0.05 to 0.4 mass % of Mg, in which the total amount of Cu and Mg is 0.3 to 0.8 mass %, with the balance being aluminum and inevitable impurities; wherein the solid conductor of an aluminum alloy shows resistance against bending of 50,000 times or more.

* * * * *

US007550675C1

(12) EX PARTE REEXAMINATION CERTIFICATE (8560th)

United States Patent

Susui et al.

(10) Number: US 7,550,675 C1

(45) Certificate Issued: Sep. 20, 2011

(54) ALUMINUM CONDUCTING WIRE

(75) Inventors: Kyota Susui, Tokyo (JP); Kazuo Yoshida, Tokyo (JP)

(73) Assignee: The Furukawa Electric Co., Ltd., Chiyoda-Ku, Tokyo (JP)

Reexamination Request:
No. 90/010,822, Jan. 13, 2010

Reexamination Certificate for:

| | |
|---|---|
| Patent No.: | **7,550,675** |
| Issued: | **Jun. 23, 2009** |
| Appl. No.: | **11/835,884** |
| Filed: | **Aug. 8, 2007** |

Related U.S. Application Data

(63) Continuation of application No. PCT/JP2006/302421, filed on Feb. 7, 2006.

(51) Int. Cl.
*H01B 7/00* (2006.01)

(52) U.S. Cl. ..... 174/110 R; 174/119 C; 174/119 R

(58) Field of Classification Search ..... None
See application file for complete search history.

(56) References Cited

U.S. PATENT DOCUMENTS 3,984,619 A 10/1976 Raw et al.

FOREIGN PATENT DOCUMENTS

JP H8-246115 9/1996

OTHER PUBLICATIONS

D. S. Clark, Ph. D et al.; "Physical Metallurgy For Engineeers"; D. Van Nostrand Company, Inc. Princeton, New Jersey; Second Edition Jan. 1962; pp. 96–97, 104–105 and 146–147.

F. J. Humphreys et al.; "Recrystallization and Related Annealing Phenomena"; Elsevier; Second Edition; pp. 2–5, pp. 215–217, pp. 228–229 and pp. 240–241.

J.R. Davis; "Aluminum and Aluminum Alloys" ASM Specialty Handbook, Davis Associates; ASM International, copyright 1993, p. 497.

R. M. Brick et al., "Structure and Properties of Alloys" The Application of Phase Diagrams to the Interpretation and Control of Industrial Alloy Structures; McGraw–Hill Book Company, 1995, pp. 114–115.

*Primary Examiner*—Minh T Nguyen

(57) ABSTRACT

An aluminum conducting wire, containing a stranded conductor that is formed by stranding solid conductors of an aluminum alloy, in which the aluminum alloy comprises 0.1 to 1.0 mass % of Fe, 0.05 to 0.5 mass % of Cu, and 0.05 to 0.4 mass % of Mg, in which the total amount of Cu and Mg is 0.3 to 0.8 mass %, with the balance being aluminum and inevitable impurities, and a solid conductor of an aluminum alloy for the aluminum conducting wire.

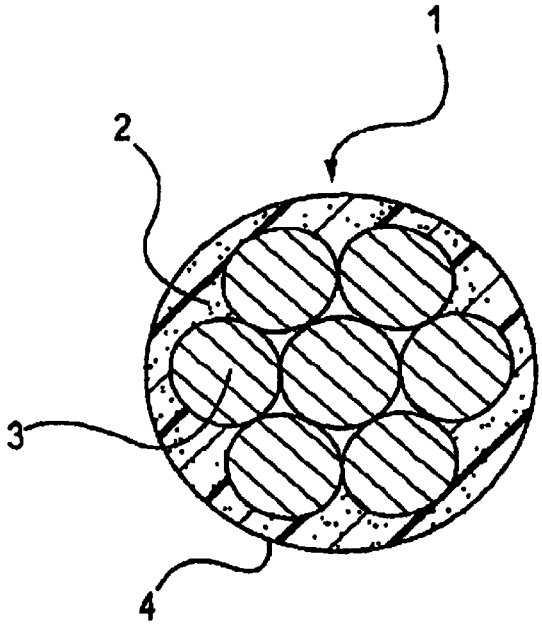

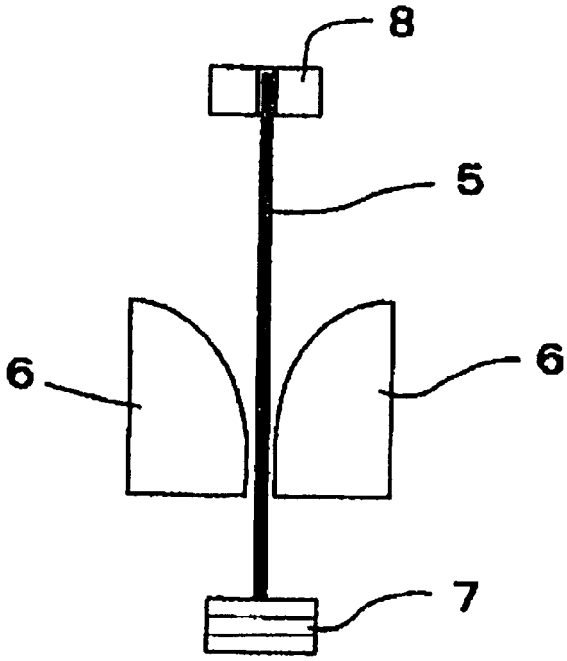

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 5 and 9 are determined to be patentable as amended.

Claims 2-4 and 6-8, dependent on an amended claim, are determined to be patentable.

New claims 10-25 are added and determined to be patentable.

1. An aluminum conducting wire, comprising a stranded conductor that is formed by stranding solid conductors of an aluminum alloy, wherein the aluminum alloy comprises 0.1 to 1.0 mass % of Fe, 0.10 mass % or less of Si, 0.05 to 0.5 mass % of Cu, and 0.05 to 0.4 mass % of Mg, in which the total amount of Cu and Mg is 0.3 to 0.8 mass %, with the balance being aluminum and inevitable impurities; [and]

wherein the solid conductors of an aluminum alloy show resistance against bending of 50,000 times or more*, and wherein the aluminum alloy is recrystallized*.

5. An aluminum conducting wire, comprising:

a stranded conductor that is formed by stranding solid conductors of an aluminum alloy; and a resin layer coating the stranded conductor;

wherein the aluminum alloy comprises 0.1 to 1.0 mass % of Fe, 0.10 mass % or less of Si, 0.05 to 0.5 mass % of Cu, and 0.05 to 0.4 mass % of Mg, in which the total amount of Cu and Mg is 0.3 to 0.8 mass %, with the balance being aluminum and inevitable impurities; wherein the solid conductors have a wire diameter of from 0.07 to 1.50 mm; [and] wherein the solid conductors of an aluminum alloy show resistance against bending of 50,000 times or more*, and wherein the aluminum alloy is recrystallized*.

9. A solid conductor of an aluminum alloy for a conducting wire, comprising 0.1 to 1.0 mass % of Fe, 0.10 mass % or less of Si, 0.05 to 0.5 mass % of Cu, and 0.05 to 0.4 mass % of Mg, in which the total amount of Cu and Mg is 0.3 to 0.8 mass %, with the balance being aluminum and inevitable impurities; wherein the solid conductor of an aluminum alloy shows resistance against bending of 50,000 times or more*, and wherein the aluminum alloy is recrystallized*.

*10. The aluminum conducting wire according to claim 1, wherein the aluminum alloy is free of Zr.*

*11. The aluminum conducting wire according to claim 5, wherein the aluminum alloy is free of Zr.*

*12. The solid conductor according to claim 9, wherein the aluminum alloy is free of Zr.*

*13. An aluminum conducting wire, comprising a stranded conductor that is formed by stranding solid conductors of an aluminum alloy, wherein the aluminum alloy comprises 0.1 to 1.0 mass % of Fe, 0.10 mass % or less of Si, 0.05 to 0.5 mass % of Cu, and 0.05 to 0.4 mass % of Mg, in which the total amount of Cu and Mg is 0.3 to 0.8 mass %, with the balance being aluminum and inevitable impurities; wherein the solid conductors of an aluminum alloy show resistance against bending of 50,000 times or more; wherein the aluminum alloy is recrystallized, and wherein a tensile strength of the aluminum conducting wire is 110 MPa to 146 MPa.*

*14. An electric wire for automobile wiring, comprising: a conductor, and a coating layer formed on the periphery of the conductor, wherein the conductor is the aluminum conducting wire according to claim 13.*

*15. An aluminum conducting wire, comprising:*

*a stranded conductor that is formed by stranding solid conductors of an aluminum alloy; and*

*a resin layer coating the stranded conductor;*

*wherein the aluminum alloy comprises 0.1 to 1.0 mass % of Fe, 0.10 mass % or less of Si, 0.05 to 0.5 mass % of Cu, and 0.05 to 0.4 mass % of Mg, in which the total amount of Cu and Mg is 0.3 to 0.8 mass %, with the balance being aluminum and inevitable impurities;*

*wherein the solid conductors have a wire diameter of from 0.07 to 1.50 mm;*

*wherein the solid conductors of an aluminum alloy show resistance against bending of 50,000 times or more;*

*wherein the aluminum alloy is recrystallized, and wherein a tensile strength of the aluminum conducting wire is 110 MPa to 146 MPa.*

*16. An electric wire for automobile wiring, comprising:*

*a conductor, and a coating layer formed on the periphery of the conductor, wherein the conductor is the aluminum conducting wire according to claim 15.*

*17. A solid conductor of an aluminum alloy for a conducting wire, comprising 0.1 to 1.0 mass % of Fe, 0.10 mass % or less of Si, 0.05 to 0.5 mass % of Cu, and 0.05 to 0.4 mass % of Mg, in which the total amount of Cu and Mg is 0.3 to 0.8 mass %, with the balance being aluminum and inevitable impurities; wherein the solid conductor of an aluminum alloy shows resistance against bending of 50,000 times or more; wherein the aluminum alloy is recrystallized and wherein a tensile strength of the aluminum conducting wire is 110 MPa to 146 MPa.*

*18. The aluminum conducting wire according to claim 13, wherein the aluminum alloy is free of Zr.*

*19. The aluminum conducting wire according to claim 15, wherein the aluminum alloy is free of Zr.*

*20. The solid conductor according to claim 17, wherein the aluminum alloy is free of Zr.*

*21. An aluminum conducting wire, consisting of a stranded conductor that is formed by stranding solid conductors of an aluminum alloy, wherein the aluminum alloy consists of 0.1 to 1.0 mass % of Fe, 0.10 mass % or less of Si, 0.05 to 0.5 mass % of Cu, and 0.05 to 0.4 mass % of Mg, in which the total amount of Cu and Mg is 0.3 to 0.8 mass %, in which the aluminum alloy is free of Zr, with the balance being aluminum and inevitable impurities; wherein the solid conductors of an aluminum alloy show resistance against bending of 50,000 times or more; wherein the aluminum alloy is recrystallized; and wherein a tensile strength of the aluminum conducting wire is 110 MPa to 146 MPa.*

*22. An electric wire for automobile wiring, comprising:*

*a conductor, and a coating layer formed on the periphery of the conductor, wherein the conductor is the aluminum conducting wire according to claim 21.*

*23. An aluminum conducting wire, consisting of:*

*a stranded conductor that is formed by stranding solid conductors of an aluminum alloy; and a resin layer coating the stranded conductor;*

*wherein the aluminum alloy consists of 0.1 to 1.0 mass % of Fe, 0.10 mass % or less of Si, 0.05 to 0.5 mass % of*

*Cu, and 0.05 to 0.4 mass % of Mg, in which the total amount of Cu and Mg is 0.3 to 0.8 mass %, in which the aluminum alloy is free of Zr with the balance being aluminum and inevitable impurities;*

*wherein the solid conductors have a wire diameter of from 0.07 to 1.50 mm;*

*wherein the solid conductors of an aluminum alloy show resistance against bending of 50,000 times or more;*

*wherein the aluminum alloy is recrystallized; and*

*wherein a tensile strength of the aluminum conducting wire is 110 MPa to 146 MPa.*

*24. An electric wire for automobile wiring, comprising:*

*a conductor, and a coating layer formed on the periphery of the conductor, wherein the conductor is the aluminum conducting wire according to claim 23.*

*25. A solid conductor of an aluminum alloy for a conducting wire, consisting of 0.1 to 1.0 mass % of Fe, 0.10 mass % or less of Si, 0.05 to 0.5 mass % of Cu, and 0.05 to 0.4 mass % of Mg, in which the total amount of Cu and Mg is 0.3 to 0.8 mass %, in which the aluminum alloy is free of Zr, with the balance being aluminum and inevitable impurities; wherein the solid conductor of an aluminum alloy shows resistance against bending of 50,000 times or more; wherein the aluminum alloy is recrystallized; and wherein a tensile strength of the aluminum conducting wire is 100 MPa to 146 MPa.*

* * * * *